US005829595A

United States Patent [19]

Brown et al.

[11] Patent Number: 5,829,595

[45] Date of Patent: Nov. 3, 1998

[54] THIN SHEET THERMOFORMED PALLET SLEEVE

[75] Inventors: Henry F. Brown; Cory D. Greene, both of Portage, Wis.

[73] Assignee: TriEnda Corporation, Portage, Wis.

[21] Appl. No.: 810,002

[22] Filed: Mar. 3, 1997

[51] Int. Cl.[6] ..... B65D 19/00

[52] U.S. Cl. ..... 206/600; 206/386; 220/1.5

[58] Field of Search ..... 206/386, 598–600; 108/51.3, 53.1, 55.1, 55.3, 55.5; 220/1.5, 4.28, 6, 7

[56] References Cited

U.S. PATENT DOCUMENTS

| | | | |
|---|---|---|---|
| 4,305,505 | 12/1981 | Hickey . | |
| 4,428,306 | 1/1984 | Dresen et al. . | |
| 4,643,314 | 2/1987 | Kidd . | |
| 4,673,087 | 6/1987 | Webb . | |
| 4,765,252 | 8/1988 | Shuert . | |
| 4,809,851 | 3/1989 | Oestreich, Jr. et al. . | |
| 4,838,418 | 6/1989 | Teixeira . | |
| 4,936,451 | 6/1990 | Shuert . | |
| 4,989,731 | 2/1991 | Shuert . | |
| 5,109,985 | 5/1992 | Rose | 206/600 |
| 5,123,541 | 6/1992 | Giannini et al. . | |
| 5,133,460 | 7/1992 | Shuert . | |
| 5,170,933 | 12/1992 | Perry | 206/600 |
| 5,356,014 | 10/1994 | Berner . | |
| 5,564,599 | 10/1996 | Barber et al. | 206/600 |
| 5,566,624 | 10/1996 | Brown et al. . | |
| 5,601,232 | 2/1997 | Greenbee | 206/600 |
| 5,651,463 | 7/1997 | Major et al. | 206/600 |
| 5,664,678 | 9/1997 | Budowski et al. | 206/600 |

OTHER PUBLICATIONS

"Robinson Sleeves," Robinson Industries, Inc., Coleman, Michigan.

"Keeper® II By World Container Corporation" flyer. ©1986, World Container Corporation, Eagan, MN.

*Primary Examiner*—Paul T. Sewell
*Assistant Examiner*—Luan K. Bui
*Attorney, Agent, or Firm*—Lathrop & Clark

[57] ABSTRACT

Two twin-sheet thermoformed thermoplastic sleeve halves engage within peripheral grooves in an underlying pallet and an overlying cover. Each sleeve half has a full wall which is connected by integrally thermoformed hinges to two partial walls. The integral connection between the sleeve walls gives advantageous rigidity to the pallet sleeve assembly, while the hinging of the walls allows economical manufacture and low volume flat storage of the sleeve halves in a knocked-down configuration. The hinges preferably have non-specific hinge axes, thereby providing long hinge life, impact resistance, and ease of operation. Vertical substrate tubes are totally encapsulated into each sleeve half to carry loads from a supported loaded pallet sleeve assembly. To effectively transfer the loads from the cover to the sleeve, sinuous transfer ridges are molded on the sleeves above and below the vertical substrate tubes. The transfer ridges are positioned directly beneath the cover reinforcing substrate to maximize the assembly's load supporting capability. The upper projecting lip of the sleeve is positioned to tend to cause the sleeve to bow inward, where interaction with the pallet contents contributes to overall stiffness. The pinch areas between the inner and outer sheets of the sleeve are preferably oval.

66 Claims, 10 Drawing Sheets

THIN SHEET THERMOFORMED PALLET SLEEVE

FIELD OF THE INVENTION

The present invention relates to pallets in general, and to pallets having pallet sleeves in particular.

BACKGROUND OF THE INVENTION

Pallets have found widespread use in industry for storing and transporting goods of all types. The configuration of the pallet greatly simplifies engaging and moving the goods on conventional fork lifts and conveying devices. For greatest space efficiency, loaded pallets are often stacked one upon another. When the palletized goods themselves are enclosed in stiff-walled containers it is possible to rest an upper pallet on the goods supported on the pallet below. Not all goods, however, can withstand directly the loads of an overhead pallet. Other goods may be of a bulk nature or randomly oriented to require side walls to retain the goods on the pallet base.

Although pallets have traditionally been constructed of hardwood materials, plastic pallets have found increasing favor where cleanliness, strength, or long life are called for. Plastic pallets are fabricated through various processes, yet the thermoforming process has been demonstrated to be particularly satisfactory to producing a sturdy and cost-effective pallet.

In the thermoforming process a sheet of thermoplastic material is heated until it becomes soft and moldable, but not fluid. The heated sheet is held against a mold, whereupon a vacuum is drawn between the mold and the plastic sheet, drawing the sheet down onto the mold, and causing the thermoplastic sheet to conform to the mold's surface. In twin-sheet thermoforming both an upper sheet and a lower sheet are heated and molded simultaneously in two separate molds. The heated sheets are then pressed together within the molds. The effect is to create an article which may have enclosed volumes, and regions of plastic of desired thicknesses.

Pallets have been converted into containers for bulk goods or non-load supporting products by the provision of a sleeve which surrounds and engages with a lower pallet and an upper cover. Corrugated plastic sheet and corrugated paperboard of various thicknesses and construction have been successfully used to form sleeves. The corrugated material has the advantage of being lightweight, rigid against vertical loads, yet easily creased to allow bending of a single sheet into the four wall panels required to encircle a conventional rectangular pallet. Yet corrugated paperboard has drawbacks which make its performance unacceptable for certain conditions, especially those involving wet or corrosive environments or uses where especially rough handling or abrasion is anticipated.

Corrugated plastic sleeves, which are sometimes formed as extrusions, have been reinforced with metal structure. However, usually the metal protrudes from the sleeve in such construction, leaving open the possibility of corrosion.

Sturdy pallet sleeves have been formed of plastic in the twin-sheet thermoforming process, as disclosed, for example, in U.S. Pat. No. 4,809,851. Such a sleeve has been comprised of four thermoformed panels which are arranged in such a way to define an enclosure.

With increasing reliance on just-in-time delivery and other advanced inventory systems, there is a growing need for pallet systems which are at once strong and lightweight; easily assembled and knocked down, yet rigid and well connected when in use. To the extent that assembly and disassembly times can be reduced, the overall cost of transporting and storing goods can be minimized. Hence a pallet and sleeve assembly is needed which is economically produced, durable, and easy to transport and assemble.

SUMMARY OF THE INVENTION

The pallet sleeve of this invention is composed of twin-sheet thermoformed thermoplastic sleeve halves which engage within peripheral grooves in an underlying pallet and an overlying cover. Each sleeve half has a full wall which is connected by integrally thermoformed hinges to two partial walls. The integral connection between the sleeve walls gives advantageous rigidity to the pallet sleeve assembly, while the hinging of the walls allows economical manufacture and low volume flat storage of the sleeve halves in a knocked-down configuration. The hinges preferably have non-specific hinge axes, thereby providing long hinge life, impact resistance, and ease of operation. Vertical substrate tubes are molded into each sleeve half to carry loads from a loaded pallet and sleeve assembly stacked upon it. To effectively transfer the loads from the cover to the sleeve, sinuous transfer ridges are molded on the sleeves above and below the vertical substrate tubes. The transfer ridges are positioned directly beneath the cover reinforcing substrate to maximize the assembly's load supporting capability.

It is an object of the present invention to provide a sleeve for a pallet which is economically manufactured.

It is another object of the present invention to provide a sleeve for a pallet assembly which is rapidly assembled and knocked down.

It is also an object of the present invention to provide a pallet sleeve assembly which can effectively carry vertical loads.

It is an additional object of the present invention to provide a sleeve for a pallet which is rigid in an assembled configuration.

It is a further object of the present invention to provide a sleeve for a pallet which can be stored in a flat condition.

It is yet another object of the present invention to provide a hinge for panels in a pallet sleeve which provides long life, is easy to operate, and which is impact resistance.

It is also an object of the present invention to provide a metal reinforced sleeve for a pallet which has no exposed metal parts.

It is a still further object of the present invention to provide a pallet sleeve which has corner structure which contributes to the overall vertical load supporting capacity of the container.

Further objects, features and advantages of the invention will be apparent from the following detailed description when taken in conjunction with the accompanying drawings.

DESCRIPTION OF THE PREFERRED EMBODIMENT

Figure 1:
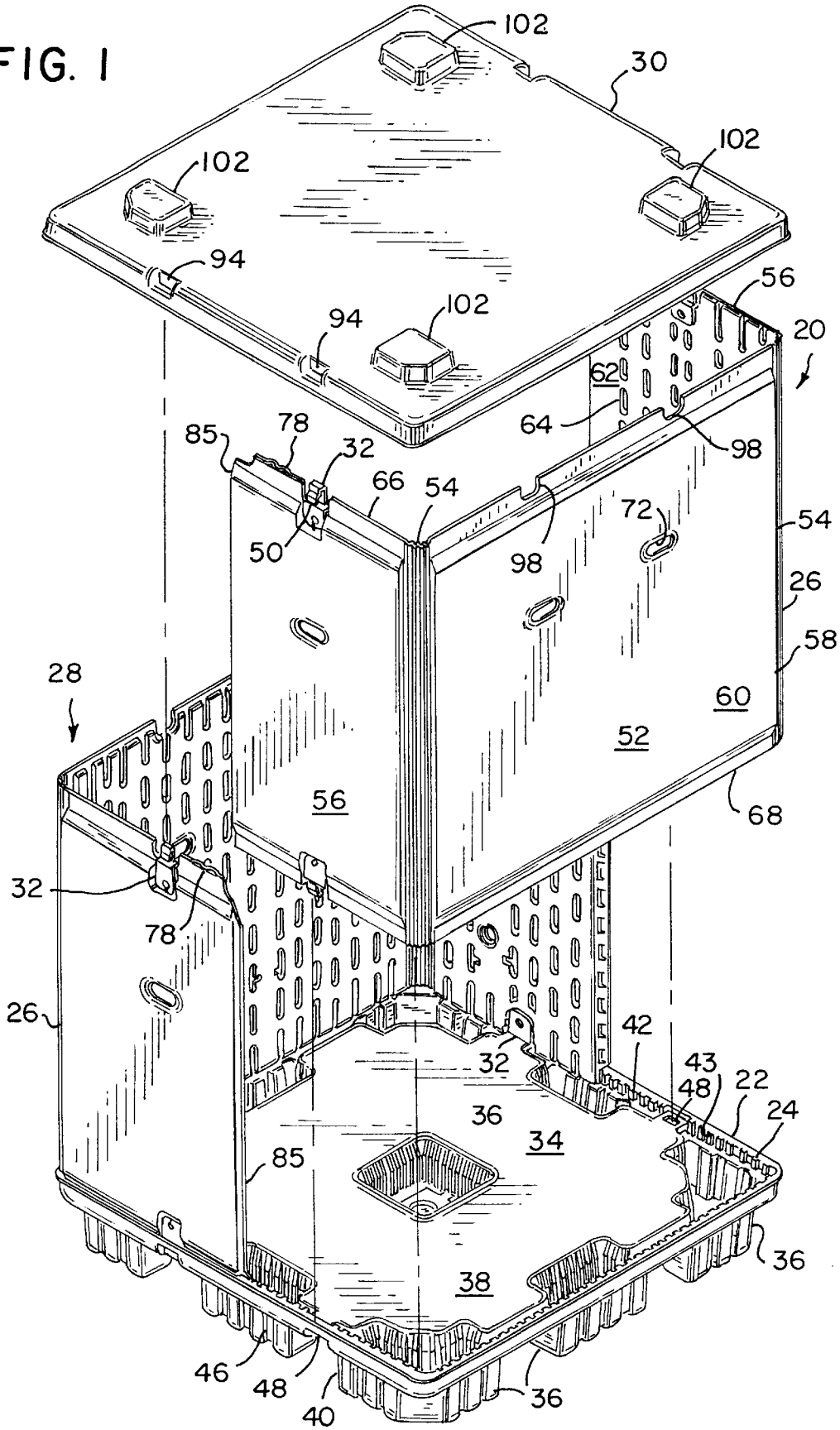
FIG. 1 is an exploded isometric view of a pallet, pallet sleeve, and cover assembly of this invention.

Referring more particularly to FIGS. 1–12, wherein like numbers refer to similar parts, a pallet sleeve assembly 20 is shown in FIG. 1. An underlying pallet 22 has a peripheral groove 24 which receives two sleeve halves 26 which together comprise the pallet sleeve 28. A cover 30 overlies the sleeve 28 to define an enclosure and to support additional pallet sleeve assemblies 20 thereon. The sleeve 28 is connected to the pallet 22 and the cover 30 by four lower and four upper connectors 32. The connectors 32 may be any appropriate fastener, but in a preferred embodiment are injection molded plastic snap-fasteners, such as those disclosed in U.S. Pat. No. 5,123,541, the disclosure of which is incorporated by reference herein.

The pallet 22 may be formed by any suitable molding process, but is preferably formed in the twin-sheet thermoforming process. The pallet has a load-supporting deck 34 with nine feet 36 which extend downwardly from the deck to engage an underlying cover 30 of a pallet sleeve assembly 20 or a support surface. The feet 36 are preferably formed by a fusion of an upper sheet 38 of thermoplastic material and a lower sheet 40 of thermoplastic material, such as in the pallet disclosed in U.S. Pat. No. 4,828,306, the disclosure of which is incorporated by reference herein.

Figure 3:
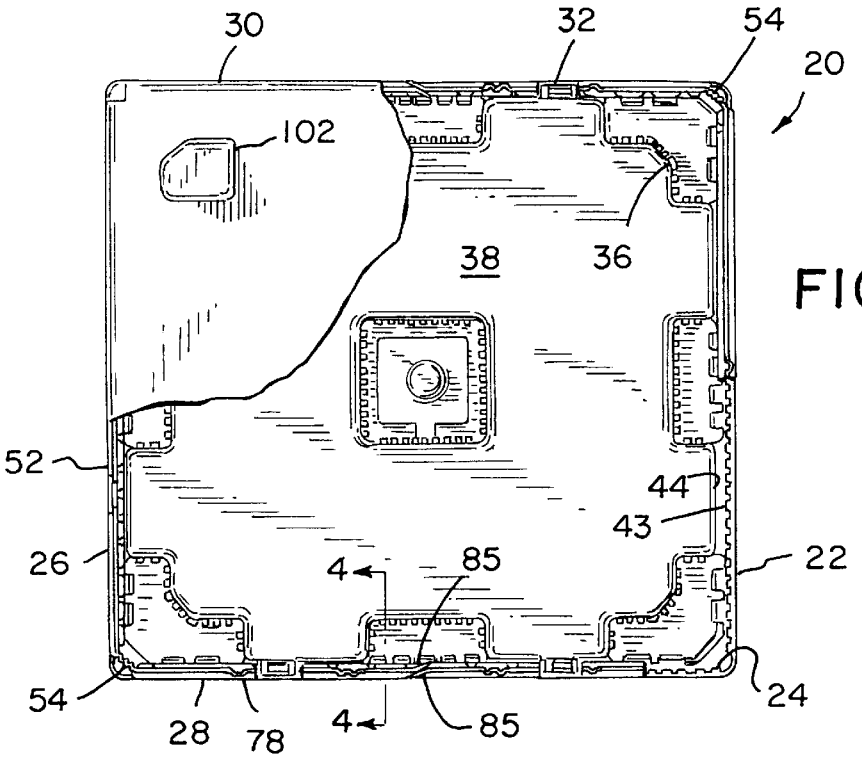
FIG. 3 is a cross-sectional view of the pallet sleeve assembly of FIG. 2 taken along section line 3—3.
Figure 4:
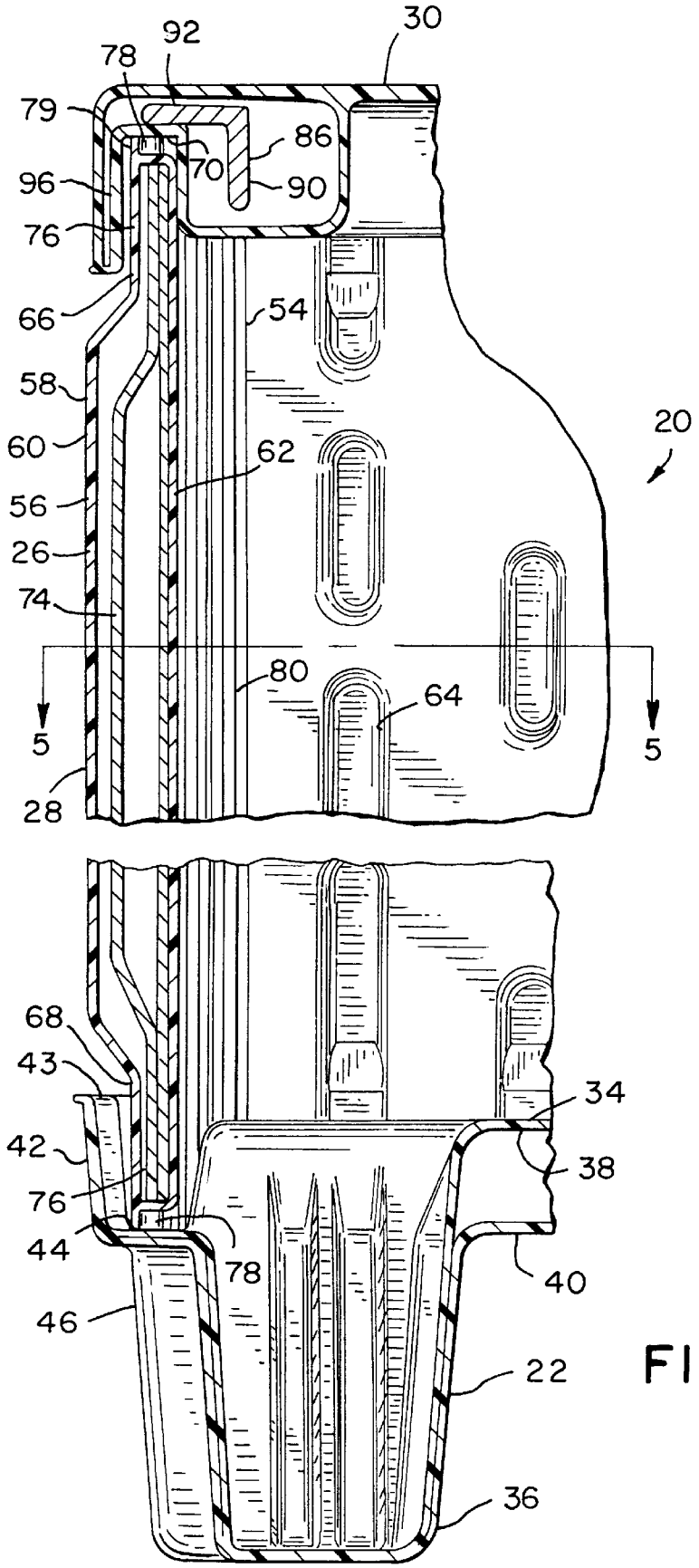
FIG. 4 is a cross-sectional view of the pallet sleeve assembly of FIG. 3 taken along section line 4—4.
Figure 10:
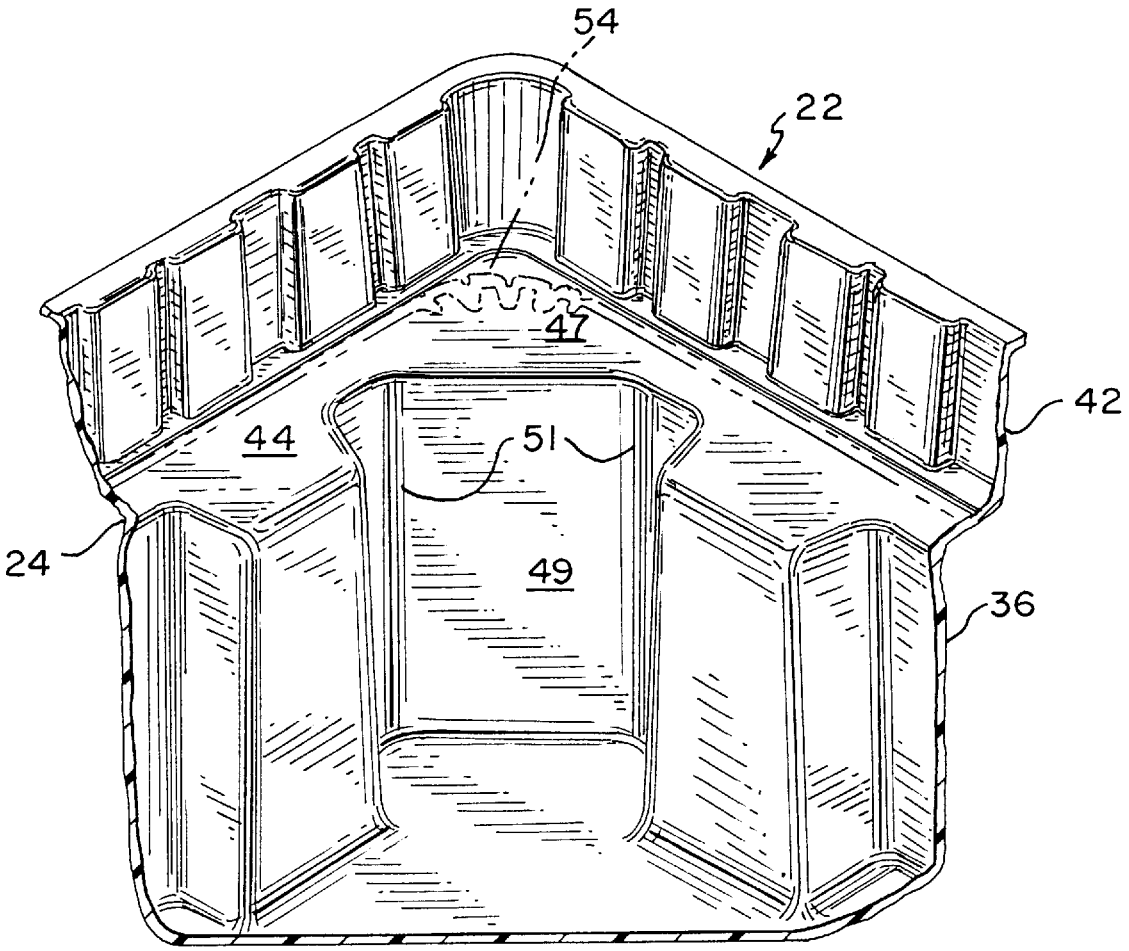
FIG. 10 is a fragmentary isometric view of a corner of the pallet of FIG. 1.

As best shown in FIG. 3, the pallet peripheral groove 24 encircles the pallet 22 and is defined on its outward edge by an upwardly extending skirt 42, best shown in FIGS. 4 and 10. The skirt 42 is angled slightly outwardly, thereby assisting in directing the sleeve 28 into the groove 24. The skirt is formed by both the upper and lower thermoplastic sheets 38, 40, and has repeated ribbing 43 which stiffens the skirt. The floor 44 of the groove is also defined by a number of ribs 46 which make up the outer walls of the feet 36 and is further defined by hinge support shelves 47. As best shown in FIG. 10, each hinge support shelf 47 is defined at a corner of the pallet extending outwardly from a corner pallet foot 36. The foot 36, rather than having a 90 degree corner, is preferably chamfered to have an angled wall 49 which extends at approximately 45 degrees from two corners 51. By chamfering the corner of the foot 36 there are two stiffened corners 51, rather than one, as would be the case with a single 90 degree angle. The chamfering also creates the shelf 47 which provides support for the sleeve hinge 54 to rest on.

Figure 2:
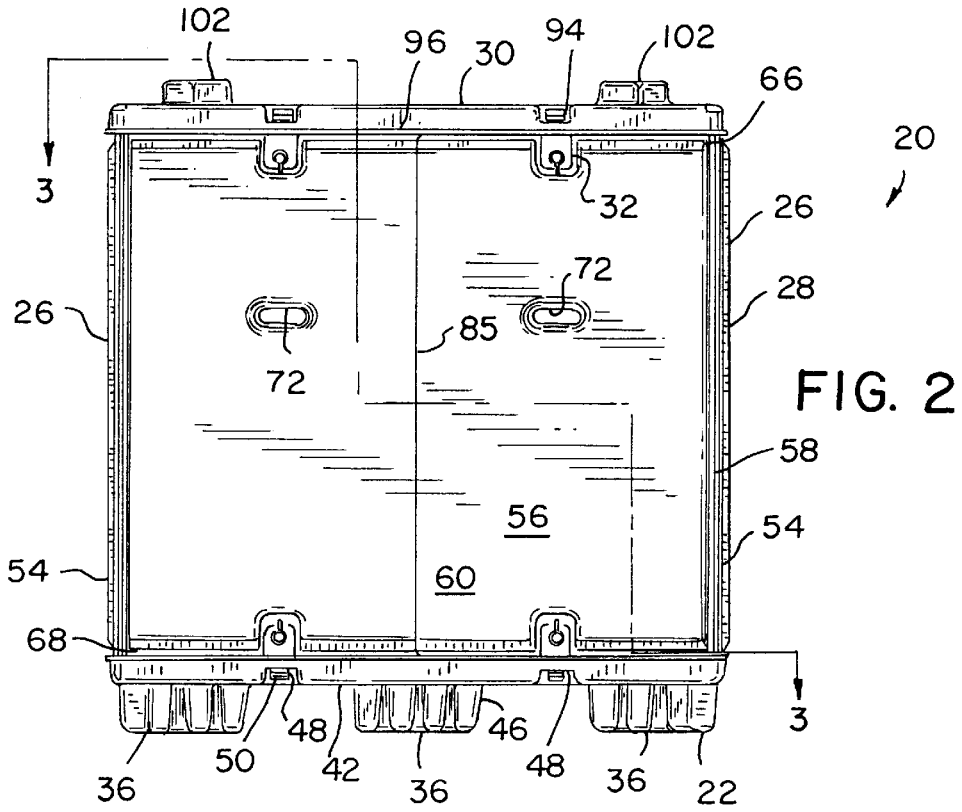
FIG. 2 is a side elevational view of the pallet sleeve assembly of FIG. 1.
Figure 8:
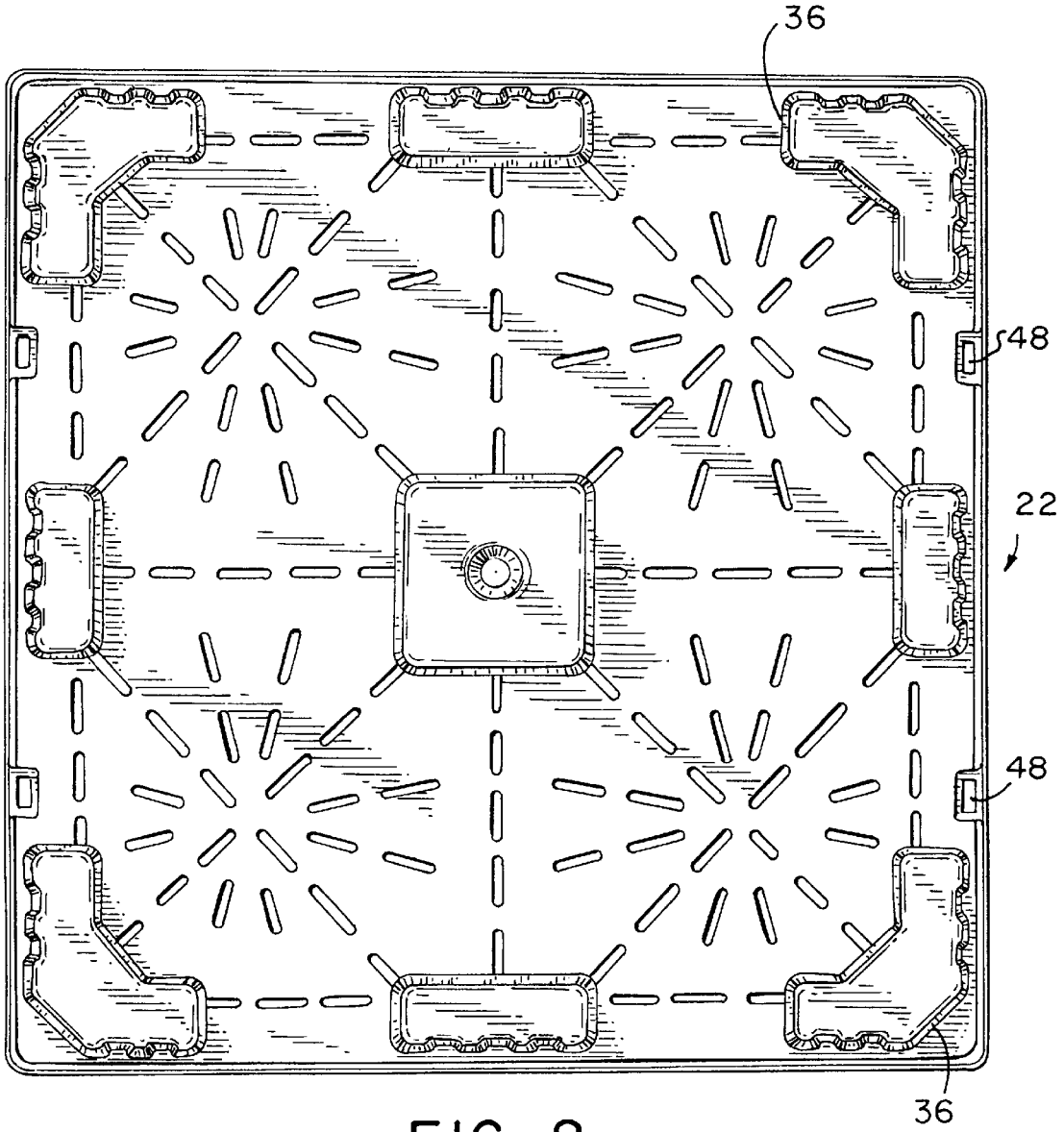
FIG. 8 is a bottom plan view of the pallet of FIG. 1.

As shown in FIGS. 2, 3, and 8, four connector receiving holes 48 are punched in the groove floor. The rectangular holes 48 receive a flexible tab 50 which extends from a connector 32, to thereby fasten the sleeve 28 to the pallet 22.

Each sleeve half 26 is a twin-sheet thermoformed thermoplastic part. The part is preferably formed from two thermoplastic sheets approximately 100–125 thousandths of an inch in thickness. Each sleeve half 26 has a full wall 52 connected by integral hinges 54 to two side partial walls 56. As shown in FIG. 4, the walls 52, 54 have a mid-section 58 which extends between the pallet 22 and the cover 30, and which is approximately one inch thick. The wall mid section 58 is essentially flat on its exterior skin 60. The exterior skin 60, however, is joined to the interior skin 62 at a plurality of oval pinch points or depressions 64. This fusion of the two skins 62, 64 imparts rigidity to the walls 54, 56. Oval pinch points are preferably employed which are of optimal size, shape and placement to address vertical column loads and internal side loads. In situations where hand cleaning of individual depressions is called for, each oval pinch point is made large enough for a worker to insert a rag on a finger for hand cleaning.

The sleeve walls 52, 54 narrow to approximately one half inch in thickness at the upper rim 66 and the lower rim 68. The lower rim 68 engages within the pallet groove 24, and rests on the groove floor 44. The upper rim 66 engages with a downwardly opening peripheral groove 70 in the cover 30. To permit visual inspection of the pallet contents without requiring the removing of a sleeve half, the walls 52, 56 may be formed with oval inspection ports 72 which are routered out to allow sight lines through the sleeve 28 and also serve as hand holds for ergonomic purposes.

Significant load carrying capacity is imparted to the sleeve 28 by reinforcing vertical substrate members 74. The reinforcing members may be formed of steel, or, alternatively, other reinforcing materials such as aluminum, where weight is a concern, or carbon fiber or even polyurethane or even different densities of polyethylene. As shown in FIG. 4, the vertical substrate members 74 are preferably formed of rectangular steel tubing, approximately ¾ inch by 1½ inch by 16 gauge. The substrate members are the full ¾ inch thickness as they extend through the mid-section section 58 of the walls 52, 56, but are crushed at the ends 76 to approximately ¼ inch in thickness. The crushed ends 76 extend into the upper rim 66 and the lower rim 68, and are approximately two inches long and two inches wide.

Figure 6:
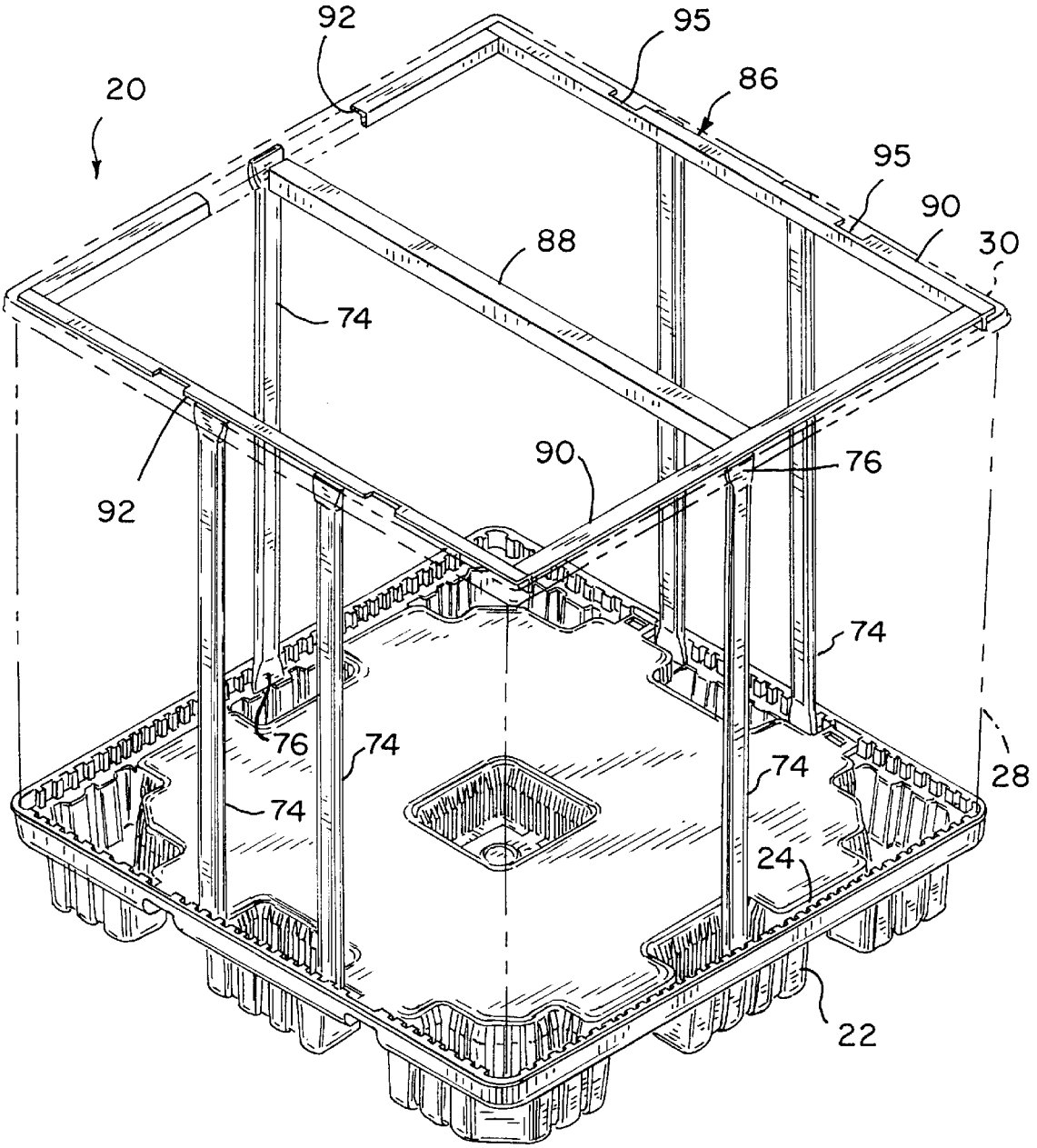
FIG. 6 is an isometric view of the pallet sleeve assembly of FIG. 1 in which the cover and sleeve have been indicated in phantom view to illustrate the metal substrate of the assembly.

As shown in FIG. 6, a vertical substrate member 74 is positioned in the full wall 52 and the two partial walls 56 of each sleeve half 26. The vertical substrate member 74 in the full wall 52 is approximately centered along the perimeter of the pallet 22. The vertical substrate members 74 in the partial walls 56 There is a trim lip, where we trim the part, about ⅛ high. are positioned on the edges of a pallet foot 36.

Figure 9:
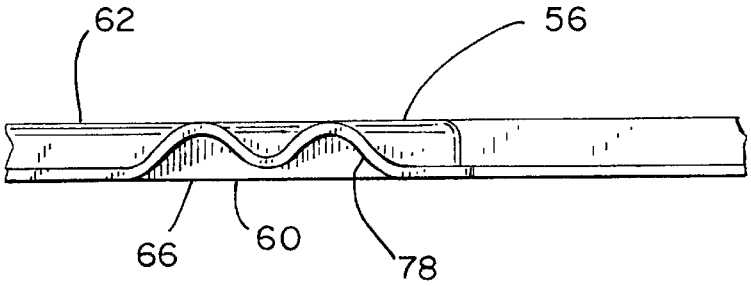
FIG. 9 is a fragmentary top plan view of the pallet sleeve of FIG. 1 showing a protruding load transfer ridge.

The steel of the vertical substrate members 74 is much denser than the plastic which comprises the sleeve walls, and the crushed substrate ends 76 are blunt. To better distribute the vertical loads onto the vertical substrate members, and lessen the possibility that the substrate ends 76 could puncture the plastic, sinuous transfer ridges 78 are molded into the sleeve walls 52, 56 adjacent each substrate end 76. The transfer ridges 78, as shown in FIG. 9, are formed at a fusion between the exterior skin 60 and the interior skin 62, and describe a generally sine wave pattern above or below a substrate end 76. The function of the transfer ridges 78 is thus to spread out the region of contact between the cover 30 or the pallet 22 and the vertical substrate members 74. The transfer ridges on the upper rim 66 are positioned as part of the trim lip 79 which is formed where the outer sheet forming the exterior skin 60 is fused to the inner sheeting forming the interior skin 62. The trim lip 79, as shown in FIG. 4, is positioned to cause the sleeve walls to bow inward and to react against contents in a manner to assist rigidity. A sleeve wall is tipped inwardly by focusing the stress on the outer skin of the sleeve. The trim is located on the outer edge of the sleeve. The trim lip by being on the outside transmits the loads downward primarily along the outer skin, with the result that it deforms the wall inward. As all the pinch points are from the sleeve interior, the stronger of the two sheets is the outer sheet. When it is column loaded it is going to bow toward the weaker side, that is inwardly. Hence the walls of the sleeve are designed to make any deformation or bowing inward, as there are just negative consequences to outward bowing.

Figure 5:
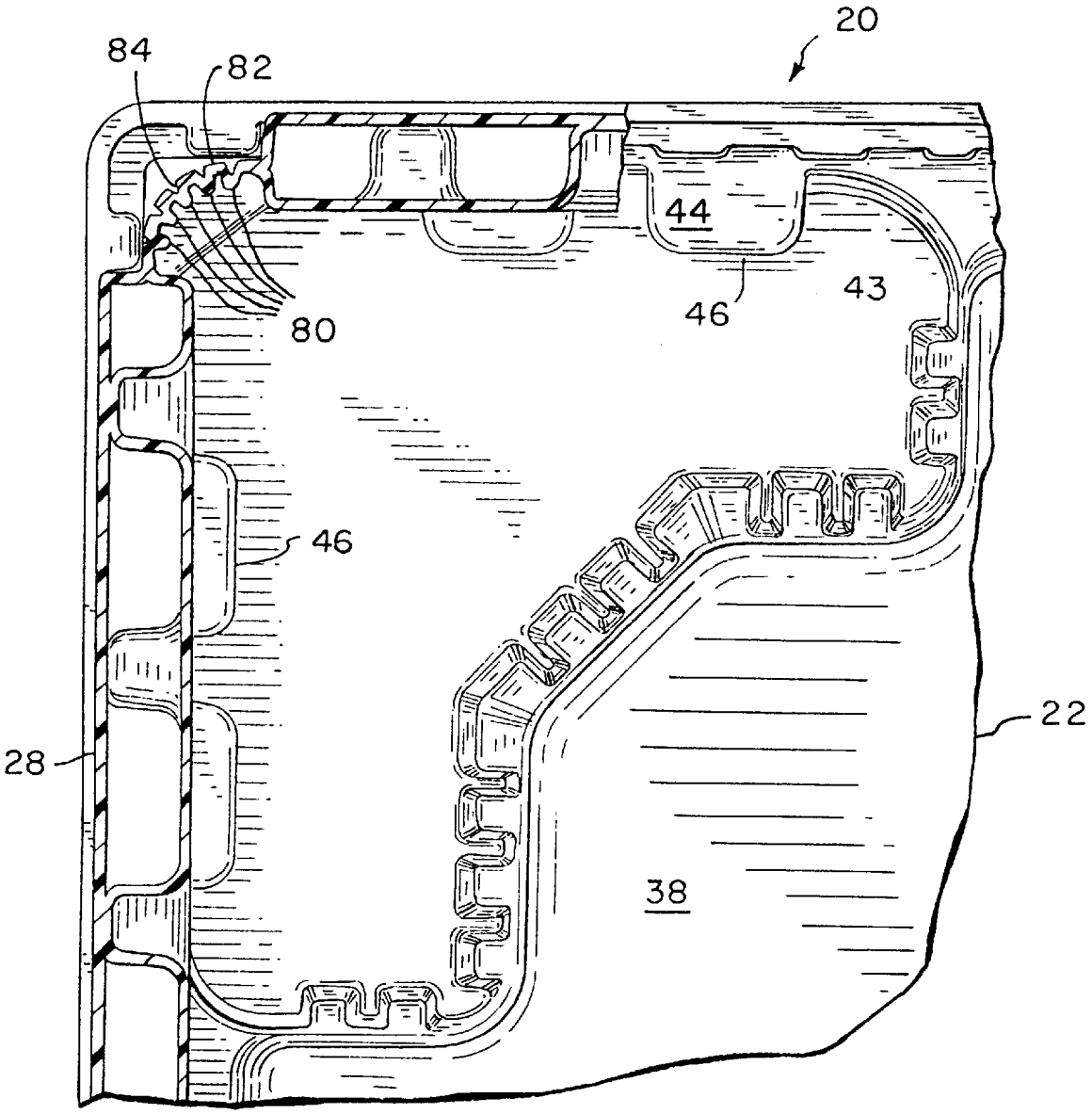
FIG. 5 is a cross-sectional view of the pallet sleeve assembly of FIG. 4 taken along section line 5—5.

The total number of molded parts required to completely encircle the pallet 22 with the sleeve 28 is minimized by connecting the walls 52, 56, of each sleeve half 26 by the integral hinges 54. As best shown in FIG. 5, each hinge 54 extends the full height of the sleeve. The hinges 54 are formed in the twin-sheet thermoforming process, in which the sleeve half 26 full wall 52 and partial walls 56 are formed in substantially the same plane, with a hinge 54 between each partial wall and the full wall. The hinges 54 are solid molded plastic, substantially without voids, and fused the entire length of the hinge. Five protruding parallel bars 80 extend the height of the sleeve 28, and extend toward the interior of the sleeve. Each bar 80 projects approximately ¼ inch from the hinge body 82. The hinge body 82 is a thickness of plastic which extends between a partial wall 56 and a full wall 52 and is about one quarter inch thick. Five V-shaped grooves 84 extend parallel to the bars 80 along each hinge 54. The V-shaped grooves 84 open to the exterior of the sleeve 28 and are relieved into the hinge body 82 to a depth of about one half the height of the bars, or about 0.12 inches. The center line of each V-shaped groove 84 is approximately aligned with the center line of a bar 80.

The effect of the hinges 54 is a very secure connection between the partial walls 56 and the full wall 52, which allows the pivoting of the partial walls with respect to the full wall so each sleeve half can take on a C-shaped configuration when it is positioned on a pallet 22, or a flat, splayed condition when it is stored. The full connection of the partial walls to the full walls, however, greatly contributes to the rigidity of the sleeve. The right-angle corner structure produced when the sleeve halves 26 are restrained in the grooves 24, 70 of the pallet 22 and the cover 30 resists deformation of the sleeve 28 from vertical loads.

The hinges 54, it will be noted, do not have a single hinge axis, but may be said to have a "non-specific" hinge axis. By this it is meant that two or more hinge axes are provided in a single hinge structure. A hinge axis may be said to exist approximately at each V-shaped groove 84. This non-specific hinge structure has several distinct advantages. First, because the plastic at each of the multiple axes does not have to bend a full ninety degrees to turn a corner, the maximum deflection of the plastic is limited, extending the life time of the overall hinge. Furthermore, any stress applied to the hinge region is distributed over the span of the hinge, rather than concentrated at a single axis, again extending the hinge life. Because the hinge is nonspecific, when subjected to impact, the stress goes to the actual point of impact, but is distributed by the flexibility of the multiple hinge axes over a larger area, this makes the impact less local, hence less intense, with the hinge being more durable. Furthermore, the non-specific hinge is more easily manipulated than a single hinge axis. Another advantage to the non-specific hinge is its tolerance for variations in dimensions of the sleeve panels. Because the corner-turn does not have to fully take place at a single location, it can fall along a range of positions above the corner support shelf 47. This acceptance of variances in panel length allows tighter tolerances between the sleeve wall thickness and the pallet and cover groove widths. This tighter tolerance in these regions contributes to a tighter fit between the sleeve and the pallet and cover, and hence a stiffer container. In addition, this acceptance of tolerance variations in the panel widths allows a common sized sleeve to be used with pallets of slightly different dimensions, varying on the order of ¼ to ½ inch. This is of particular value in manufacturing sleeves for specialized pallets, for example, dunnage trays. Users of such pallets can require specialized pallet dimensions that are only a fraction of an inch different from a standard pallet size. A sleeve which can accommodate these variations can present substantial cost savings to the customer.

The two sleeve halves 26 are formed with ramped mating edges 85, as shown in FIG. 3. The mating edges 85 are formed on each of the four partial walls 56. Hence the mating edge 85 of one partial wall 56 overlaps with a corresponding mating edge of another sleeve half 26. The overlapping of the walls at the mating edges 85 helps to prevent infiltration of foreign matter through the sleeve 28, as well as jointly resisting the outward bending of the sleeve walls. Alternatively, the overlapping could be accomplished with a tongue and groove arrangement or other mating means.

As shown in FIG. 6, the cover 30 has an internal reinforcing substrate 86 which is molded between the inner and outer skin of thermoplastic material in the twin-sheet thermoforming process. The substrate 86 has a central square tubular member 88 which supports the center leg 36 of an overlying pallet, thereby transferring load to support 74 protecting contents and is connected to right angle members 90 welded into a square and extending around the cover 30. As shown in FIG. 4, the angle members 90 have an outwardly extending leg 92 which extends horizontally above the cover groove 70 which receives the sleeve upper rim 66. Loads disposed on the cover are thus readily transferred to the cover reinforcing substrate 86, and through the angle member legs 92 to the sleeve 28 and the sleeve vertical substrate members 74. The loads on the vertical substrate members 74 are then carried to the pallet 22.

Figure 7:
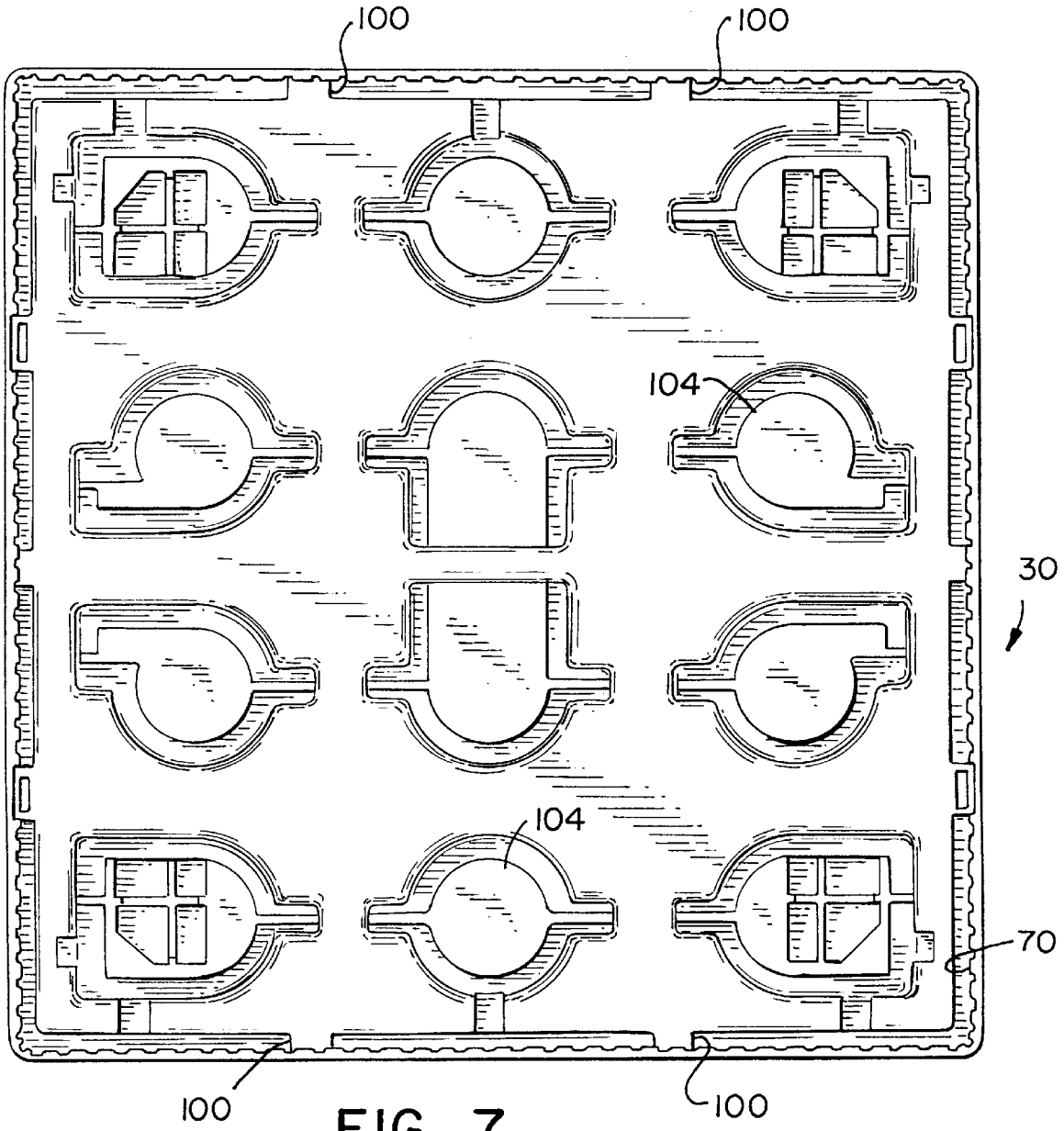
FIG. 7 is a bottom plan view of the cover of FIG. 1.

As shown in FIGS. 1 and 7, four connector receiving holes 94 are punched or cut in the cover to receive the snap connectors 32. As shown in FIG. 6, the cover substrate angle members 90 are cut away at the locations of the holes 94 to define openings 95 to permit the connectors to pass through the substrate. As shown in FIG. 4, the cover 30 has a downwardly extending skirt 96 which extends peripherally around the groove 70 to restrain the engaged sleeve 28 from outward displacement.

Although the connectors 32 are located, in a preferred embodiment, only along the sleeve partial walls, a mechanical positioning engagement between the cover 30 and the sleeve full walls 52 is provided by cut-away portions 98 in the upper rim 66 of the full walls which engage with downwardly extending protrusions 100 located in the corresponding position on the underside of the cover 30, as shown in FIG. 7. The protrusions 100 further serve to stiffen the downwardly extending skirt 96 and prevent excessive outward bowing of the skirt.

To restrict horizontal displacement of an upper pallet sleeve assembly 20 with respect to a lower one, the cover 30 is preferably provided with four protruding blocks 102, shown in FIGS. 2 and 3, which extend upwardly and which engage inwardly of the corner feet 36 of an overlying pallet 22.

The pallet sleeve assemblies 20 may be advantageously used with a wide variety of bulk goods, specialized products, or articles in dunnage trays or the like. The illustrated example may be employed for containing stacked containers of agricultural chemicals. The cover 30 thus may be molded with recesses 104, shown in FIG. 7, to receive the tops of containers. Typically, in a use where specialized articles are being conveyed, a molded tray (not shown) may be disposed on the pallet 22 within the skirt 42.

If desired, the sleeve walls may be formed with a slight inward bow, such that the walls engage against the load carried on the pallet. In such an arrangement the load would thus contribute to the overall stiffness of the sleeve.

When assembled the pallet sleeve assemblies 20 may be used to ship and store goods over a wide range of conditions. Once the goods have been delivered to their final destination, the assemblies 20 may be broken down into pallets, covers, and sleeve halves 26 for compact shipment back to a loading site, where the parts can be reassembled and used many times again. The pallet sleeve assembly 20 thus comprises a container in which goods may be shipped and stored. In addition, at the place of use, the assembly 20 may be partially broken down by removing the cover, or by removing one of the two sleeve halves to allow access to the container contents. As parts produced in the twin-sheet thermoforming process win usually have one or more punctures therein for the entrance of air-injecting blow pins, to retain the water tight nature of the sleeve, it is desirable to plug any such holes with "Christmas tree plugs."

Figure 11:
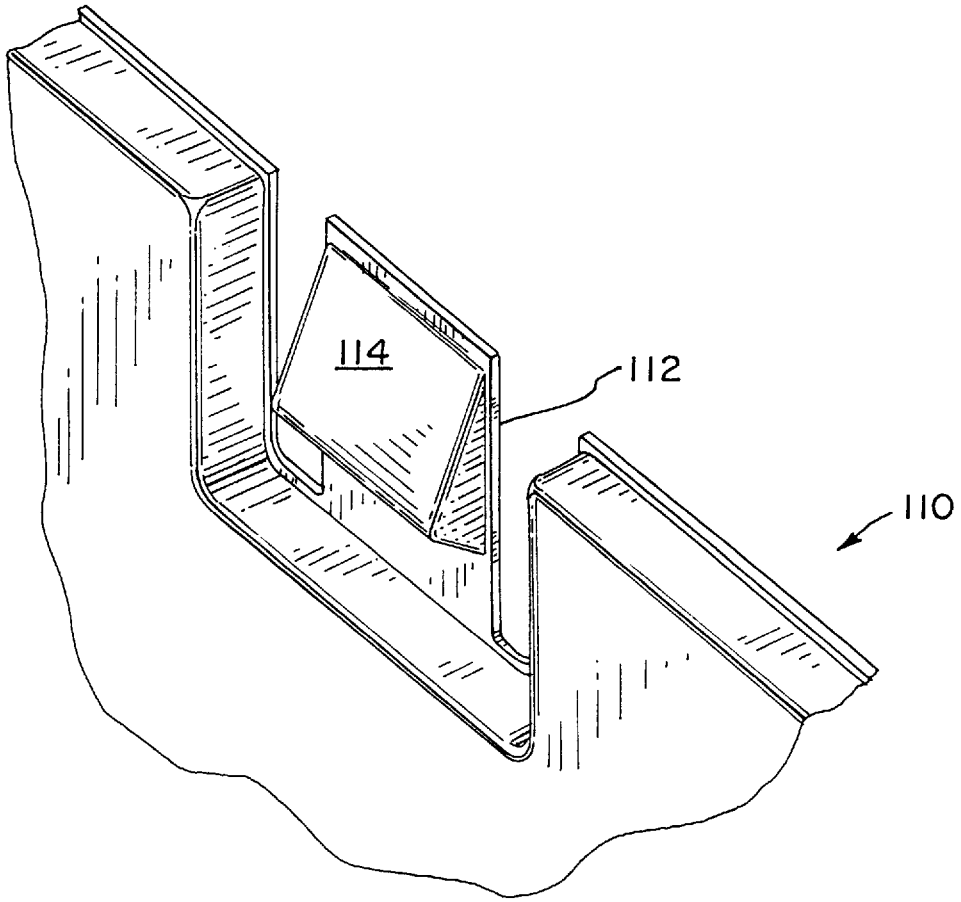
FIG. 11 is a fragmentary isometric view of an alternative embodiment sleeve of this invention, in which the sleeve clips are bayonets formed integrally with the sleeve.

An alternative embodiment sleeve 110, shown in FIG. 11, has a plastic connector 112 which is formed as one-piece with the sleeve 110 in the twin sheet thermoforming process. The connector 112 has a protruding bayonet 114 which narrows as it extends away from the sleeve and which is sized to be inserted into an opening in a pallet or a cover. Such a connector 112 would provide a more permanent connection between the sleeve and the cover or pallet, although it could be removed, if needed, albeit with less ease than the snap-connectors discussed above.

It should be noted that although the sleeve of this invention has been disclosed as having two pieces, it could be made as one piece, and for many uses would be constructed in that way. The single piece sleeve could be thermoformed as one or pieces, and welded or mechanically joined together to form a single closed sleeve.

Figure 12:
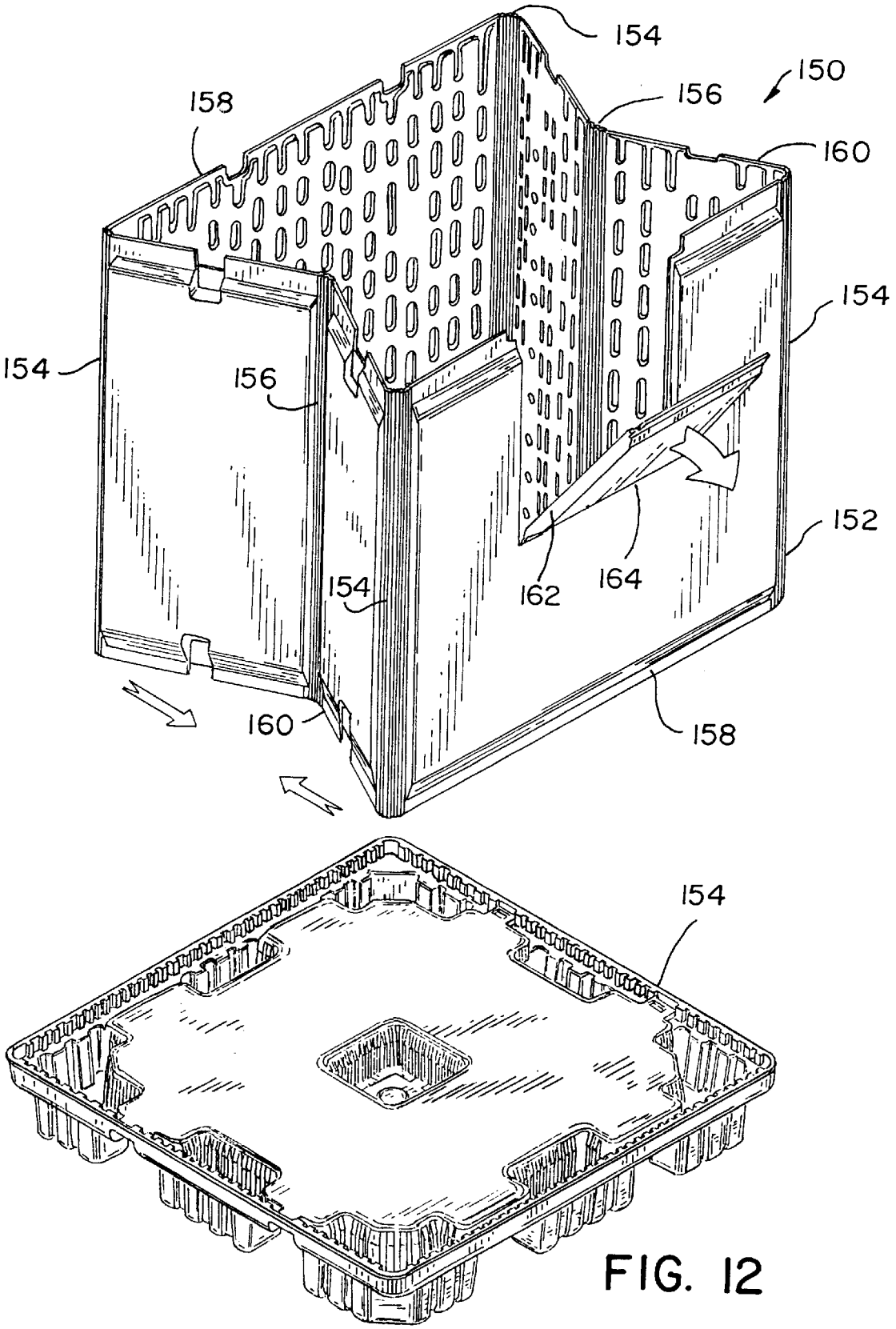
FIG. 12 is an exploded isometric view of an alternative embodiment container of this invention, in which the sleeve has partial walls which are hinged to allow the unassembled sleeve to be collapsed in a Z-fold.

As shown in FIG. 12, an alternative embodiment pallet 150 of this invention has a single closed sleeve 152 which engages within a pallet 154 which may be similar to the pallet 22 discussed above. To facilitate compact storage of the unassembled sleeve 152, the sleeve can be thermoformed to have not only nonspecific hinges 154 at the four corners of the sleeve, but also hinges 156 midway between the end walls 158 on the two side walls 160. These midway hinges 156 will preferably be formed with the hinge bars facing outwardly, and allow the side walls 160 to be collapsed so that the sleeve may be folded in a manner commonly referred to as a Z-fold in the industry. As shown in FIG. 12, the sleeve of this invention may be provided with a drop gate 162 which pivots outwardly to provide access to the sleeve interior without needing to remove the sleeve. The drop gate 162 extends along a pivot axis 164 positioned partway up an end wall 158. Such drop gates allow the loading and unloading of a pallet sleeve assembly, particularly by hand labor.

It should be noted that although the pallet described above is disclosed as not having a metal reinforcing structure, such reinforcement may be provided where particular loads require the additional stiffness. Furthermore, although vertical substrate members have been discussed in the sleeves of this invention, in particular cases it may be desirable to connect the vertical members in the sleeves with horizontal reinforcing members. This would particularly be the case where it is necessary to stack one loaded pallet directly on an underlying sleeve without a cover.

In addition, although rectangular sleeve and pallet arrangements have been disclosed above, the container and sleeve of this invention may be formed to different shapes, for example regular or irregular hexagons or octagons. Furthermore, it may be desirable in certain circumstances, for reasons of increased stiffness, to place short angled walls at mid points along the pallet. Such angled walls might also be connected by the non-specific hinges disclosed above. The portions which engage between the half walls of the sleeve may also be other than the ramp structure discussed above, for example tongue and groove or other interlocking or overlapping structure.

It is understood that the invention is not limited to the particular construction and arrangement of parts herein illustrated and described, but embraces such modified forms thereof as come within the scope of the following claims.

We claim:

1. A container comprising:

a plastic pallet having an upwardly opening peripheral groove;

a twin-sheet thermoformed thermoplastic sleeve having walls which extend upwardly from the plastic pallet, the walls having portions which extend into the pallet peripheral groove, each wall being formed in the twin-sheet thermoforming process from a first sheet of thermoplastic material which is fused to a second sheet of thermoplastic material to define a plurality of depressions where the first sheet is fused to the second sheet, unfused regions being defined between vertically spaced depressions; and a hinge extending between two sleeve walls approximately perpendicular to one another, wherein the hinge and portions of the two perpendicular walls are formed as one piece in the twin-sheet thermoforming process, the hinge being comprised of the first sheet of thermoplastic material being fused to the second sheet of thermoplastic material throughout the region defined by the hinge, and wherein each hinge has a vertically extending hinge body, a plurality of substantially parallel bars which extend inwardly from the hinge body, and a plurality of grooves on the exterior of the hinge body, said grooves extending parallel to the bars, such that the sleeve may be removed from the pallet and the walls pivoted about the hinge to bring the two walls into approximately the same plane.

2. The container of claim 1 wherein the sleeve comprises at least two sleeve halves, wherein each sleeve half comprises:

one full wall which extends along a first pallet side;

a first hinge extending vertically along the full wall;

a first partial wall extending from the full wall along the first hinge, wherein the width of the first partial wall is less than the full width of a pallet side which extends perpendicular to the first pallet side;

a second hinge extending vertically along the full wall and spaced from the first hinge; and a second partial wall extending from the full wall along the second hinge, wherein the width of the second partial wall is less than the full width of a pallet side which extends perpendicular to the first pallet side, wherein the full wall, the first hinge, the first partial wall, the second hinge, and the second partial wall are formed in the twin-sheet thermoforming process to be one piece.

3. The container of claim 2 wherein at least one vertical substrate member is positioned within each of the first partial wall, the full wall, and the second partial wall of both sleeve halves.

4. The container of claim 2 wherein each of the sleeve half partial walls has a vertically extending inclined ramp which engages with a ramp of opposite inclination on an opposed sleeve half partial wall.

5. The container of claim 1 further comprising a cover which overlies the sleeve and engages with the sleeve above the pallet.

6. The container of claim 5 further comprising at least one vertical substrate member positioned within a sleeve wall, the vertical substrate member extending between the cover and the pallet.

7. The container of claim 6 further comprising plastic portions of the sleeve which extend upwardly to define a transfer ridge, the ridge being positioned above the vertical substrate and serving to distribute vertical loads to the vertical substrate member.

8. The container of claim 7 wherein the transfer ridge extends in a sinuous path along the sleeve.

9. The container of claim 7 further comprising a transfer ridge positioned beneath said vertical substrate member.

10. The container of claim 1 wherein portions of a sleeve wall define an inspection opening permitting a line of sight from the sleeve exterior to the sleeve interior.

11. The container of claim 1 wherein the sleeve has a lower rim which is narrower than the pallet groove, and the sleeve has a mid-section extending upwardly from the lower rim which is wider than the pallet groove.

12. The container of claim 1 wherein the pallet has a skirt which extends upwardly exterior to the pallet groove.

13. The container of claim 1 further comprising a plurality of connectors which extend between the sleeve and the pallet, connecting the sleeve to the pallet.

14. The container of claim 13 further comprising a cover engaged over the sleeve, and a plurality of connectors which extend between the sleeve and the cover, connected the cover to the sleeve.

15. The container of claim 1 wherein the sleeve is a single closed element, having four walls, wherein each wall is connected by a hinge.

16. The container of claim 15 wherein the sleeve has two full end walls, and two side walls connecting the end walls, and wherein each side wall has at least one vertically extending hinge formed therein, such that the end walls may be collapsed together, with the side walls folded inwardly therebetween in a Z-fold.

17. The container of claim 15 wherein the sleeve has a wall with portions defining a pivotable drop gate, which pivots about a horizontal axis to allow access to goods stored on the pallet.

18. The container of claim 1 wherein the pallet has a horizontal support shelf underlying the hinge.

19. The container of claim 1 wherein the hinge has five bars and five grooves.

20. The container of claim 1 wherein the sleeve has a wall with portions defining a pivotable drop gate, which pivots about a horizontal axis to allow access to goods stored on the pallet.

21. The container of claim 1 wherein each bar extends inwardly from the hinge body approximately one quarter of an inch.

22. A container comprising:

a plastic pallet having an upwardly opening peripheral groove;

a twin-sheet thermoformed thermoplastic sleeve having walls which extend upwardly from the plastic pallet, the walls having portions which extend into the pallet peripheral groove, each wall being formed from a first sheet fused to a second sheet;

a hinge extending between two sleeve walls approximately perpendicular to one another, wherein the hinge and portions of the two perpendicular walls are formed as one piece, and the hinge is a fusion between said first sheet and said second sheet, the hinge having a plurality of outwardly opening, parallel grooves, such that the sleeve may be removed from the pallet and the walls pivoted about the hinge to bring the two walls into approximately the same plane;

a cover which overlies the sleeve and engages with the sleeve above the pallet; and a reinforcing substrate positioned within the cover.

23. The container of claim 22 wherein the cover reinforcing substrate comprises a rectangular structure of right angle members, and a tubular member which extends between two right angle members.

24. A container comprising:

a plastic pallet having an upwardly opening peripheral groove;

a twin-sheet thermoformed thermoplastic sleeve having walls which extend upwardly from the plastic pallet, the walls having portions which extend into the pallet peripheral groove; and a hinge extending between two sleeve walls approximately perpendicular to one another, wherein the hinge and portions of the two perpendicular walls are formed as one piece, such that the sleeve may be removed from the pallet and the walls pivoted about the hinge to bring the two walls into approximately the same plane;

a cover which overlies the sleeve and engages with the sleeve above the pallet;

a reinforcing substrate positioned within the cover, wherein the cover substrate is positioned above said at least one vertical substrate member in the sleeve wall such that loads carried by the cover substrate are directed to the vertical substrate member.

25. A container comprising:

a plastic pallet having an upwardly opening peripheral groove;

a twin-sheet thermoformed thermoplastic sleeve having walls which extend upwardly from the plastic pallet, the walls having portions which extend into the pallet peripheral groove;

a hinge extending between two sleeve walls approximately perpendicular to one another, wherein the hinge and portions of the two perpendicular walls are formed as one piece, such that the sleeve may be removed from the pallet and the walls pivoted about the hinge to bring the two walls into approximately the same plane; and a cover which overlies the sleeve, wherein the sleeve has an outwardly facing exterior skin, and an inwardly facing interior skin, and wherein portions of the exterior skin are fused to the interior skin to define a trim lip which extends above the sleeve, the trim lip being positioned closer to the exterior of the sleeve than the interior of the sleeve, wherein the trim lip is positioned to engage the overlying cover and thereby cause the sleeve walls to bow inwardly toward a load contained within the container.

26. A container comprising:

a pallet having an upwardly facing deck;

a twin-sheet thermoformed thermoplastic sleeve, the sleeve being formed from a first thermoplastic sheet to define an outer skin of the sleeve and a second thermoplastic sheet to define an inner skin of the sleeve, the sleeve having walls which extend upwardly from the pallet, said first thermoplastic sheet being fused to said second thermoplastic sheet at a plurality of regions, portions of the sheets being spaced from one another at regions between the fused regions, wherein portions of the first sheet are fused to the second sheet to define an upwardly extending first hinge between and pivotably connecting two walls, the hinge having a plurality of parallel, outwardly facing grooves formed therein;

a cover which is positioned over the pallet and supported on and engaged with the sleeve walls;

at least one vertical substrate member positioned in the sleeve and fused between the outer skin and the inner skin, the substrate member extending between the cover and the pallet; and portions of the sleeve which extend above the vertical substrate to define a ridge which protrudes above the substrate, the ridge being formed by portions of the outer skin and the inner skin, the ridge engaging against the cover to support loads applied by the cover to the sleeve.

27. The container of claim 26 wherein the sleeve comprises at least two sleeve halves, wherein each sleeve half comprises:

one full wall which extends along a first pallet side the first hinge extending vertically along the full wall;

a first partial wall extending from the full wall along the first hinge, wherein the width of the first partial wall is less than the full width of a pallet side which extends perpendicular to the first pallet side;

a second hinge extending vertically along the full wall and spaced from the first hinge; and a second partial wall extending from the full wall along the second hinge, wherein the width of the second partial wall is less than the full width of a pallet side which extends perpendicular to the first pallet side, wherein the full wall, the first hinge, the first partial wall, the second hinge, and the second partial wall are formed in the twin-sheet thermoforming process to be one piece.

28. The container of claim 27 wherein at least one vertical substrate member is positioned within each of the first partial wall, the full wall, and the second partial wall of both sleeve halves.

29. The container of claim 28 wherein a ridge is positioned above each vertical substrate member.

30. The container of claim 29 wherein a ridge is positioned below each vertical substrate member.

31. The container of claim 27 wherein each of the sleeve half partial walls has a vertically extending inclined ramp which engages with a ramp of opposite inclination on an opposed sleeve half partial wall.

32. The container of claim 26 wherein the ridge extends in a sinuous path along the sleeve.

33. The container of claim 26 further comprising a reinforcing substrate positioned within the cover, wherein the cover substrate is positioned above said at least one vertical substrate member in the sleeve wall such that loads carried by the cover substrate are directed to the vertical substrate member.

34. The container of claim 26 wherein portions of a sleeve wall define an inspection opening permitting a line of sight from the sleeve exterior to the sleeve interior.

35. The container of claim 26 wherein the pallet has an upwardly opening groove, and the sleeve has a lower rim which is narrower than the pallet groove, and the sleeve has a mid-section extending upwardly from the lower rim which is wider than the pallet groove.

36. The container of claim 26 wherein the pallet has a skirt which extends upwardly exterior to the pallet groove.

37. The container of claim 26 further comprising a plurality of connectors which extend between the sleeve and the pallet, connecting the sleeve to the pallet.

38. The container of claim 37 further comprising a plurality of connectors which extend between the sleeve and the cover, connecting the cover to the sleeve.

39. The container of claim 26 wherein the sleeve has a plurality of walls which are connected by hinges.

40. The container of claim 39 wherein each hinge comprises:

a vertically extending hinge body;

a plurality of substantially parallel bars which extend inwardly from the hinge body; and a plurality of grooves on the exterior of the hinge body, said grooves extending parallel to the bars.

41. The container of claim 40 wherein each hinge has five bars and five grooves.

42. The container of claim 40 wherein each bar has a vertically extending centerline, and wherein each groove has a vertically extending centerline, and wherein each bar has a groove which is positioned approximately directly outwardly therefrom such that the centerlines of said outwardly positioned grooves are parallel to and aligned with the centerlines of the bars.

43. The container of claim 40 wherein each bar extends inwardly from the hinge body approximately one quarter of an inch.

44. The container of claim 26 wherein the sleeve is a single closed element, having four walls, wherein each wall is connected by a hinge.

45. The container of claim 44 wherein the sleeve has two full end walls, and two side walls connecting the end walls, and wherein each side wall has at least one vertically extending hinge formed therein, such that the end walls may be collapsed together, with the side walls folded inwardly therebetween in a Z-fold.

46. The container of claim 26 wherein the sleeve has a wall with portions defining a pivotable drop gate, which pivots about a horizontal axis to allow access to goods stored on the pallet.

47. A container comprising:

a pallet having an upwardly facing deck;

a twin-sheet thermoformed thermoplastic sleeve, the sleeve being formed from a first thermoplastic sheet to define an outer skin of the sleeve and a second thermoplastic sheet to define an inner skin of the sleeve, the sleeve having walls which extend upwardly from the pallet;

a cover which is positioned over the pallet and supported on and engaged with the sleeve walls;

at least one vertical substrate member positioned in the sleeve between the outer skin and the inner skin, the substrate member extending between the cover and the pallet; and portions of the sleeve which extend above the vertical substrate to define a sinuous ridge which protrudes above the substrate, the ridge being formed by portions of the outer skin and the inner skin, the ridge engaging against the cover to support loads applied by the cover to the sleeve a reinforcing substrate positioned within the cover; and a reinforcing substrate positioned within the cover.

48. The container of claim 47 wherein the cover reinforcing substrate comprises a rectangular structure of right angle members, and a tubular member which extends between two right angle members.

49. A container comprising:

a pallet having an upwardly facing deck;

a twin-sheet thermoformed thermoplastic sleeve, the sleeve being formed from a first thermoplastic sheet to define an outer skin of the sleeve and a second thermoplastic sheet to define an inner skin of the sleeve, the sleeve having walls which extend upwardly from the pallet;

a cover which is positioned over the pallet and supported on and engaged with the sleeve walls;

at least one vertical substrate member positioned in the sleeve between the outer skin and the inner skin, the substrate member extending between the cover and the pallet;

portions of the sleeve which extend above the vertical substrate to define a ridge which protrudes above the substrate, the ridge being formed by portions of the outer skin and the inner skin, the ridge engaging against the cover to support loads applied by the cover to the sleeve; and wherein portions of the exterior skin are fused to the interior skin to define a trim lip which extends above the sleeve, the trim lip being positioned closer to the exterior of the sleeve than the interior of the sleeve, wherein the trim lip engages with the cover and thereby causes the sleeve walls to bow inwardly toward the load contained within the container.

50. A container comprising:

a pallet having portions defining at least one upwardly opening peripheral groove; and two twin-sheet thermoformed thermoplastic sleeve halves, each sleeve half having one full wall which extends along a pallet side, and two partial walls which extend from the full wall along a hinge, the full wall, the hinges, and the two partial walls of each sleeve being formed as one piece, wherein the two sleeve halves are engaged with the pallet groove and extend upwardly from the pallet to define four walls which surround the pallet, the partial walls of each pallet have engaging against the partial walls of the other sleeve half, and wherein each sleeve half is formed from a first thermoplastic sheet fused to a second thermoplastic sheet at a plurality of locations, including along each hinge, a plurality of spaced pockets being thereby formed on each wall, and wherein the hinges have outwardly facing vertically extending grooves formed therein.

51. The container of claim 50 further comprising a cover which overlies the sleeve and is engaged with the two sleeve halves.

52. The container of claim 50 further comprising a plurality of vertically extending reinforcing members which are formed within each of the full wall and the two partial walls of each of the sleeve halves.

53. The container of claim 50 wherein the pallet has a plurality of ribs which extend downwardly from the peripheral groove to support the sleeve halves thereon.

54. The container of claim 50 wherein the two sleeve halves are substantially identical to one another.

55. The container of claim 50 wherein each sleeve half is formed from a first thermoplastic sheet defining a outer skin, and a second thermoplastic sheet defining an inner skin, and wherein the outer skin is substantially planar, and wherein a plurality of recesses are formed in the inner skin which are fused to the outer skin at selected regions, to thereby stiffen and reinforce the sleeve half.

56. A twin-sheet thermoformed thermoplastic sleeve half for engagement with a like sleeve half to define a sleeve extending between a pallet of a first width and a cover, the sleeve half comprising:

one full wall which extends approximately the first width;

a first hinge extending vertically along the full wall;

a first partial wall extending from the full wall along the first hinge, wherein the width of the first partial wall is less than width of the full wall;

a second hinge extending vertically along the full wall and spaced from the first hinge; and a second partial wall extending from the full wall along the second hinge, wherein the width of the second partial wall is less than width of the full wall, and wherein the full wall, the first hinge, the first partial wall, the second hinge, and the second partial wall are formed in the twin-sheet thermoforming process to be one piece, wherein the first hinge and the second hinge each have a vertically extending hinge body, a plurality of substantially parallel bars which extend inwardly from the hinge body, and a plurality of grooves on the exterior of the hinge body, said grooves extending parallel to the bars.

57. The sleeve half of claim 56 wherein each sleeve half is formed from a first thermoplastic sheet defining a outer skin, and a second thermoplastic sheet defining an inner skin, and wherein the outer skin is substantially planar, and wherein a plurality of recesses are formed in the inner skin which are fused to the outer skin at selected regions, to thereby stiffen and reinforce the sleeve half.

58. The sleeve half of claim 56 wherein at least one vertical substrate member is positioned within each of the first partial wall, the full wall, and the second partial wall of the sleeve half.

59. The sleeve half of claim 58 wherein a load transfer ridge is positioned above each vertical substrate member.

60. The sleeve half of claim 59 wherein a load transfer ridge is positioned below each vertical substrate member.

61. The sleeve half of claim 56 wherein each of the sleeve half partial walls has a vertically extending inclined ramp which engages with a ramp of opposite inclination on an opposed sleeve half partial wall.

62. The sleeve half of claim 59 wherein the load transfer ridges extend in a sinuous path along the sleeve.

63. The sleeve half of claim 56 wherein portions of a sleeve wall define an inspection opening permitting a line of sight from the sleeve exterior to the sleeve interior.

64. The sleeve half of claim 56 wherein the hinges have five bars and five grooves.

65. The sleeve half of claim 56 wherein each bar has a vertically extending centerline, and wherein each groove has a vertically extending centerline, and wherein each bar has a groove which is positioned approximately directly outwardly therefrom such that the centerlines of said outwardly positioned grooves are parallel to and aligned with the centerlines of the bars.

66. The sleeve half of claim 56 wherein each bar extends inwardly from the hinge body approximately one quarter of an inch.

* * * * *